US006548183B2

(12) United States Patent
Kobayashi et al.

(10) Patent No.: US 6,548,183 B2
(45) Date of Patent: Apr. 15, 2003

(54) METAL-BASED COMPOSITE MATERIAL AND METHOD OF PRODUCING THE SAME

(75) Inventors: Yoshifumi Kobayashi, Hyogo (JP); Nobuyuki Kuroki, Chiba (JP); Fumiyoshi Kurosu, Saitama (JP)

(73) Assignees: Tocalo Co., Ltd., Kobe (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/740,968

(22) Filed: Dec. 21, 2000

(65) Prior Publication Data

US 2001/0005556 A1 Jun. 28, 2001

(30) Foreign Application Priority Data

Dec. 24, 1999 (JP) ..... 11-367351

(51) Int. Cl.[7] ..... B22F 3/26; C23C 22/78; C22F 11/04

(52) U.S. Cl. ..... 428/550; 428/553; 428/566; 428/650; 148/242; 148/688; 148/703; 164/97

(58) Field of Search ..... 428/539.5, 550, 428/650, 553, 566; 501/153; 148/242, 688, 703; 164/97

(56) References Cited

U.S. PATENT DOCUMENTS 3,888,661 A * 6/1975 Levitt et al.
4,988,645 A * 1/1991 Holt et al.
5,277,989 A * 1/1994 Aghajanian et al.
5,454,425 A * 10/1995 Kao
5,981,085 A * 11/1999 Ninomiya et al.
6,355,340 B1 * 3/2002 Singh et al.

FOREIGN PATENT DOCUMENTS

| | | |
|---|---|---|
| JP | 61165265 | 7/1986 |
| JP | 61295344 | 12/1986 |
| JP | 63-67133 | 3/1987 |
| JP | 1147030 | 6/1989 |
| JP | 1-279713 | 11/1989 |
| JP | 1-279720 | 11/1989 |
| JP | 1-279721 | 11/1989 |
| JP | 5126179 | 5/1993 |
| JP | 60070143 | 4/1995 |
| JP | 8-117964 | 5/1996 |

OTHER PUBLICATIONS

English Language Abstract of JP 61–295344, (no date).
English Language Abstract of JP 8–117964, (no date).
English Language Abstract of JP 61–165265, (no date).
English Language Abstract of JP 63–67133, (no date).
English Language Abstract of JP 1–279713, (no date).
English Language Abstract of JP 1–279720, (no date).
English Language Abstract of JP 1–279721, (no date).
English Language Abstract for JP Appln. No. 5–126179.
English Language Abstract for JP Appln. No. 1–147030.
English Language Abstract for JP Appln. No. 60–70143.

* cited by examiner

*Primary Examiner*—John J. Zimmerman
*Assistant Examiner*—Jason Savage
(74) *Attorney, Agent, or Firm*—Greenblum & Bernstein, P.L.C.

(57) ABSTRACT

A metal-based composite material is formed by impregnating a matrix metal of Al or Al alloy into ores of a porous preform of a hydrogenatable metal having a metal hydride in at least a part of its surface.

18 Claims, 3 Drawing Sheets

METAL-BASED COMPOSITE MATERIAL AND METHOD OF PRODUCING THE SAME

BACKGROUND OF THE INVENTION

1. Field of the Invention

This invention relates to a composite material, and more particularly to a metal-based composite material and a method of producing the same by impregnating a matrix metal consisting of Al or an Al alloy containing Mg, Cu, Si or the like into a porous preform containing a metal hydride.

2. Description of Related Art

As a method of providing a dispersion-reinforced or fiber-reinforced type metal-based composite material by impregnating a metal melt as a matrix into a porous preform made of a reinforcing material, there are known techniques such as molten metal penetration method, melt casting method and the like disclosed in JP-A-61-295344, JP-A-8-117964 and the like.

In the conventional technique of producing the composite material by impregnating the metal melt into the porous body, however, the outermost surface layer is covered with a chemically stable reaction product layer such as an oxide or the like, or the oxide and the like are at a chemically or physically adsorbed state as an impurity, so that the wettability of the metal melt to a shaped body is poor and hence it is difficult to form a composite only by contacting them with each other. This means that an active energy inherent to free surface of the metal can not effectively be utilized for forming the composite material in the conventional technique.

On the other hand, a method of forming the composite material by surely impregnating a metal melt into a porous body is examined. In this case, it is required to apply a very high pressure, or it is required to preliminarily heat the preform at a high temperature in an inert gas, or it is required to add a specific element or compound for improving the wettability to the melt or prefrom (for example, JP-A-61-165265, JP-A-62-67133 and the like). Of course, it is required to use a special equipment for conducting the application of pressure or the preheating.

As the other conventional technique, there are proposed methods wherein pressure is not applied to the metal melt, or the preform is not preliminarily heated and the like (for example, JP-A-1-279713, JP-A-1-279729, JP-A-1-279721 and the like).

Such a conventional technique not using the pressure application of the preheating is a method wherein a given amount of a metal fluoride is added to the preform and the wettability is improved by utilizing a reducing action of fluorine to the impurity to promote the composite formation. Even in this method, the active energy inherent to the free surface of the metal is not effectively utilized for forming the composite material. Furthermore, fluorine included in the metal fluoride is a gas at room temperature and indicates a highest electronegativity among all elements and is a most reactivity rich substance and hence reacts with any elements other than helium, neodymium and argon. Therefore, it is unfavorable to frequently use such a metal fluoride or the like in industrial applications from a viewpoint of an environment.

SUMMARY OF THE INVENTION

It is, therefore, an object of the invention to simply provide a metal-based composite material having a good wettability between a porous structural body and a melt of a matrix metal and hence a good adhesion property therebetween in a low cost without conducting pressure application of preheating and adding specific component or compound having a high reactivity.

The inventors have made various examinations on the technique of effectively utilizing the active energy inherent to the free surface of the metal, particularly a technique of simplifying a composite formation course according to the molten metal penetrating method in order to solve the aforementioned problems in the composite formation of different metals. As a result, it has been confirmed that hydrogenatable metals (inclusive of alloys), for example, metals such as Ti, Ni, Fe, Co and the like or an alloy consisting essentially of these metals have a property of absorbing and releasing a gas of two atoms through a heating-cooling cycle (Sievert's law: a solubility of a gas of two atom molecule such as hydrogen in a metal or the like at a certain temperature [% H] is proportional to a square root of partial pressure $P_H$ of the gas of two atom molecule at an equilibrium state).

Especially, it has been found that when such a characteristic of hydrogen that absorbability and releasability are excellent is given to these metals, the active state inherent to the free surface of the metal constituting the porous body is controlled, which can effectively be served to form the composite material.

Under the above situations, the inventors have made various studies for achieving the above object. As a result, it has been found out that a method wherein a porous body is shaped by using a hydrogenatable metal such as Ti Ni, Fe, Co or the like or an alloy consisting essentially of such a metal and a porous preform of a metal hydride is formed in at least a part of the resulting shaped body and a matrix metal of Al or Al alloy containing one or more selected from Mg, Cu and Si is impregnated into the preform through a molten metal penetrating method is effective as a method of forming a composite material. According to this method, when the metal hydride in the preform is heated to a temperature higher than the shaping temperature in the course of the composite formation, hydrogen is released to render the free surface of the metal constituting the porous body into an active state, whereby the good wettability to so-called molten matrix metal can be ensured.

That is, the invention is a technique of applying a phenomenon that certain kinds of metals or alloys have reversible property capable of absorbing or releasing hydrogen to the composite formation of metals, i.e. a technique of effectively utilizing the active energy inherent to the free surface of the metal for the composite formation.

BRIEF DESCRIPTION OF THE DRAWINGS

The invention will be described with reference to the accompanying drawings, wherein.

DETAILED DESCRIPTION OF THE INVENTION

Figure 1:
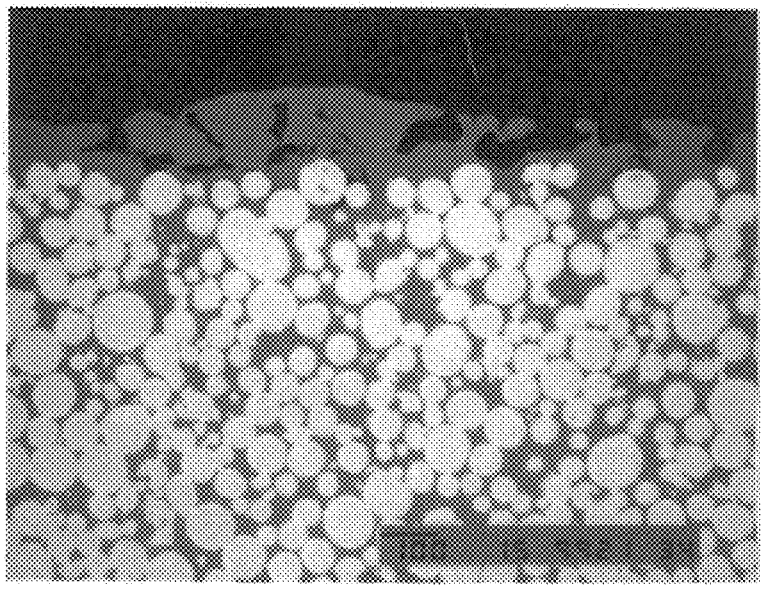
FIG. 1 is an electron microphotograph of Ti—Al composite material in Example 1 showing an image of its reflecting electron radiation composition.
Figure 1:
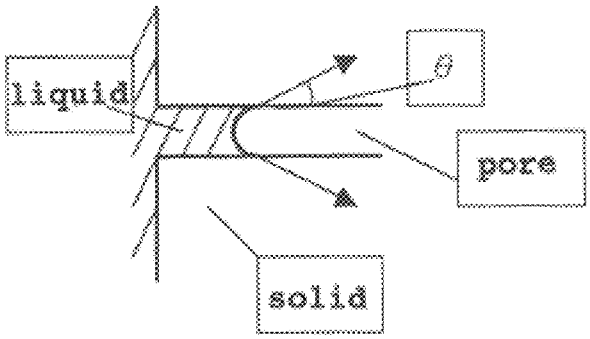

In the composite technique utilizing the molten metal penetrating method according to the invention, it is required to improve a wetting resistance produced among a metal-based porous preform, a matrix metal and molten alloy. For this end, it is favorable to form an immersion wetting state that a contact angle shown in FIG. 1 is rendered into a small angle of not more than 90° as far as possible. In such a state, the wettability is considerably improved, whereby it is possible to conduct a composite formation of both substances without pressurization. Hereinafter, such a composite formation under no pressure through the melt penetrating method is explained as a no-pressure penetrating method. That is, a characteristic of the no-pressure penetrating method according to the invention lies in a point that a special additive for improving the wettability is not used, which is largely different from the conventionally reported composite formation technique.

Firstly, the above preform is obtained by shaping Ti, Ni, Fe, Co or a hydrogenatable metal-alloy composed mainly of these metals at an atmosphere state that an oxygen partial pressure is controlled to not more than 1013 Pa, preferably not more than 100 Pa under such an atmosphere of a mixed gas of an inert gas such as Ar, He or the like and $H_2$ that $H_2$ or $H_2$ partial pressure is controlled into a porous body having an average pore diameter of 10–30 $\mu$m and a porosity of 20–80 vol %. Moreover, when the temperature or pressure in the shaping atmosphere is adjusted in the shaping of the porous body, the free surface of the metal in the porous body to be shaped absorbs hydrogen to form a metal hydride to thereby render the porous body into a chemically stable state.

As a concrete method of producing the preform containing the thus shaped metal hydride, there can be adapted a pressure-reduced plasma spraying method, a powder metallurgical sintering method (press shaping method, injection shaping method) and the like as described in the following examples. For example, when hydrogen is used as a plasma actuating gas in case of the pressure-reduced plasma method, or when hydrogen is used as an atmosphere gas during the sintering in case of the powder metallurgical sintering method, a metal hydride can be formed in at least a part of the surface of the shaped body. Furthermore, as a more positive means in these production methods, it is effective to spray powder of the metal hydride itself to directly shape into a desired form.

The thus obtained porous preform containing the metal hydride in at least a part thereof is immersed in a bath of Al or a matrix metal of Al alloy containing at least one selected from Mg, Cu and Si without preliminarily heating, whereby the preform and the matrix metal are rendered into a composite body through the impregnation of the matrix metal. In the course of the composite formation, the metal hydride in the preform releases hydrogen by heating and hence the free surface of the metal constituting the porous body returns to the active state to provide a good wettability to the matrix metal.

In this case, according to the method of the invention, when the melt of the matrix metal is impregnated into the porous preform, the inside of the pore in the porous preform is activated to improve the wettability, so that the impregnation of the matrix metal into the preform occurs in a short time even if the treating atmosphere is not pressurized. That is, the molten metal penetrating method according to the invention can be said to be a method that the above composite formation course can be considerably simplified by using the hydrogenatable metal.

As the hydrogenatable metal used in the invention, mention may be made of Ti, Fe, Ni, Al, Cu, Mg, Co, W, Mn, Cr, Be and alloys thereof. Especially, it is effective that solubility of hydrogen at a temperature of 500–600° C. is 0.1–10 $cm^3$/100 g of metal. The reason why the solubility of hydrogen is limited to the above range is due to the fact that when it is less than 0.1 $cm^3$/100 g of metal, the sufficient wettability is not obtained in the impregnation of molten metal, while when it exceeds 10 $cm^3$/100 g of metal, the generation of bubbles from the melt becomes vigorous and there is caused a risk of explosion. Preferably, it is 0.5–5 $cm^3$/100 g of metal.

In the porous body obtained by shaping the hydrogenated compositable metal such as Ti, Ni, Fe or the like, the porosity is adjusted to 20–80 vol %. When the porosity of the porous body is less than 20 vol %, closed pores becomes large and it is impossible to completely fill the molten metal in the porous body, while when it exceeds 80 vol %, the strength of the preform is lacking and it is difficult to maintain the shape. Preferably, the porosity is 30–70 vol %.

In case of the porous shaped body having such a porosity or the prefrom, each starting powder constituting such a body absorbs hydrogen molecule form its surface according to Sievert's law, and hence at least a part of the free surface of the porous body is covered with a metal hydride and chemically stabilized. At such a state, the preform develops an effect of preventing oxidation and adsorption of foreign matter because the active energy of the free surface of the pore is small.

Moreover, these effects are dependent upon a labyrinth ratio in addition to the porosity of the porous body. The term "labyrinth ratio" used herein means a ratio of actual pore length to a shortest distance between two points of a particular pore to be noticed (flexing ratio). Moreover, the labyrinth ratio is proportional to dispersion of individual pore size to average pore size and hence the number of branches in one pore. The labyrinth ratio is preferably not less than 2 but not more than 5. It is considered that the labyrinth ratio becomes large as the starting material is an active metal.

In the invention, therefore, it is effective to adjust the shaping conditions, grain sizes of starting materials and their mixed state in accordance with the material of the preform and its characteristics to render a network of pore connection into a structure easily absorbing hydrogen as far as possible. And also, it is effective to hardly release hydrogen solid-soluted in the inner surfaces of the pores in the porous shaped body.

According to the inventors' experiments, in order to satisfy the above conditions, it is confirmed that it is favorable to form a porous body having an average pore size of 10–30 $\mu$m and a porosity of 20–80 vol %.

The preform is immersed in a bath of a matrix metal selected from Al and Al alloy containing at least one of Mg, Cu and Si without pressurization or preheating for the composite formation. In the course of such a composite treatment, a metal base in the preform is at a state of preventing oxidation, and if temperature rises, it is activated to release the solid-soluted hydrogen and the free surface again turns to an active state.

In this way, the matrix metal melt is activated to penetrate into the network of pore connection in the preform having an improved wettability and finally the network of pore connection is smoothly filled with the matrix metal.

As seen from the above, according to the invention, wet activated energy required for the composition formation between the porous preform of the material selected from the hydrogenatable metal of Ti, Ni, Fe or the like and the matrix metal consisting of Al or the alloy mainly containing Mg, Cu and Si is naturally obtained in the reaction course that the metal base in the preform absorbs and releases hydrogen.

Moreover, all hydrogen solid-soluted in the preform is substantially released in such a reaction course or can completely be removed by conducting an adequate heat treatment (for example, 300° C.~800° C.×60~600 min) after the composite formation.

The following examples are given in illustration of the invention and are not intended as limitations thereof.

EXAMPLE 1

A porous preform having a rectangular shape of 100 mm in length, 25 mm in width and 3 mm in thickness and containing a hydrogenated titanium is prepared by plasma-spraying Ti powder having a purity of 99.6 mass % (grain size≦150 μm) under a reduced pressure in an atmosphere having an oxygen partial pressure of 1013 Pa with a mixed gas of Ar and $H_2$ having a $H_2$ partial pressure of 13330 Pa as a plasma working gas. The shape and weight of the preform are measured, from which the porosity is calculated to be 63.8 vol % (labyrinth ratio: 3.5). And also, the hydrogen content of the preform is measured by an inert gas melting method to be 0.7–2 mass %.

Then, 350 g of A5052 aluminum alloy is melted in a crucible for metal melt to prepare a matrix alloy bath. The above preform is immersed in the temperature of the matrix alloy bath at 680° C. for 30 seconds and pulled out therefrom and solidified by cooling in air at room temperature.

Figure 2:
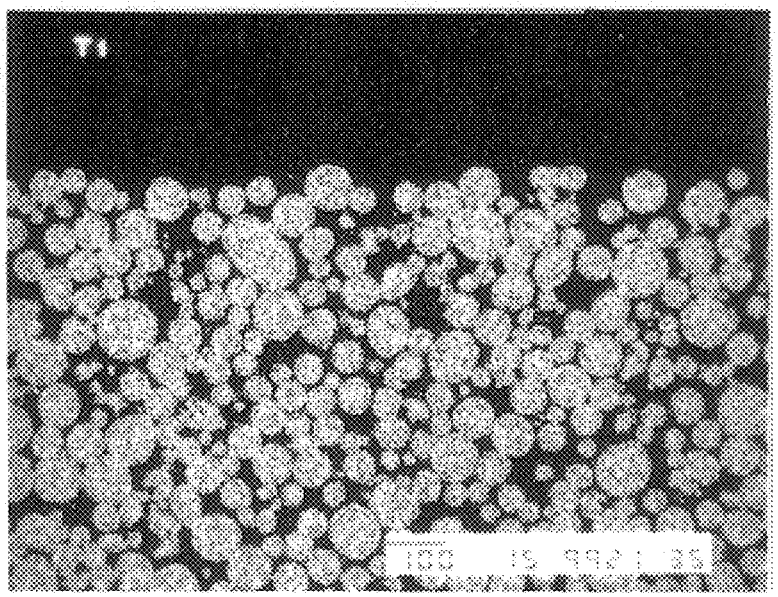
FIG. 2 is an electron microphotograph of Ti—Al composite material in Example 1 showing an X-ray image of Ti—$K_\alpha$ characteristics (corresponding to Ti preform)
Figure 3:
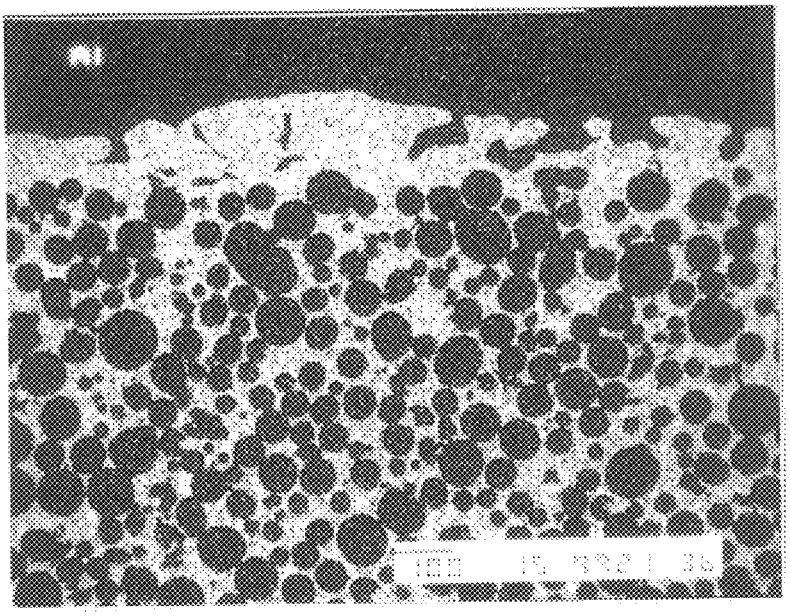
FIG. 3 is an electron microphotograph of Ti—Al composite material in Example 1 showing an X-ray image of Al—$K_\alpha$ characteristics (corresponding to Al impregnated material).

When the shape of the thus obtained aluminum alloy impregnated preform is measured, it is substantially coincident with the shape of the preform before the impregnation treatment. And also, when the density of the aluminum alloy impregnated preform is determined by the measurement of weight (3352 kg/m$^3$), it is substantially coincident with a density of a composite material (3360 kg/m$^3$) determined assuming that aluminum alloy is completely filled in the pores of the preform. Furthermore, when the solidified sample is cut and the cut face is polished and observed by means of an electron microscope, as shown in FIGS. 1, 2 and 3, it has been confirmed that the right amount of aluminum alloy is uniformly impregnated in a whole of the preform and an extremely thin diffusion layer is formed in a joint boundary between Ti and Al alloy and fully adhered to form a composite material.

Moreover, a similar result is obtained even when α type or β type Ti alloy is used as a material of the preform, or a good composite result is obtained even when the aluminum alloy bath is changed into a pure Al bath.

For the comparison, the preform is prepared un the same conditions as mentioned above except that hydrogen is not used as a plasma working gas, which is immersed in the aluminum alloy bath to form a composite material. As a result, the impregnation of aluminum alloy into the preform is hardly observed.

Further, the penetration rate of liquid into the porous body is proportional to a surface energy of the liquid and in inverse proportion to a viscosity of the liquid, so that it is considered that it is advantageous to set the bath temperature to a high value in case of the aluminum alloy bath. Now, the pure Ti preform prepared under the condition that hydrogen is not used as a plasma working gas is immersed in the bath at a setting temperature of 720° C., 750° C. or 780° C. for 3 minutes for the composite formation. In this case, however, the impregnation of aluminum alloy into the preform is not substantially observed.

On the other hand, even in case of the pure Ti preform prepared under the condition that hydrogen is used as a plasma working gas, when the porosity is less than 20 vol % or more than 80 vol %, the impregnation of aluminum alloy is incomplete and the good composite formation is difficult.

EXAMPLE 2

This example shows a case that porous sprayed film of 3 mm in thickness is formed by spraying titanium powder onto a substrate. In this example, A5052 aluminum alloy and SUS304 stainless steel having a thickness of 5 mm is used as the substrate, and the shape and other preparing conditions and the method of forming a metal hydride through a treatment using Ti powder and $H_2$ containing plasma working gas are the same as in Example 1. And also, 350 g of A5052 aluminum alloy is melted in a crucible for a metal melt and the preform provided with the sprayed film (porosity 65 vol %, labyrinth ratio 3.4) is immersed therein at a temperature of 720° C. for 30 seconds and pulled out therefrom and solidified by cooling in air at room temperature.

As the shape of the thus obtained preform is measured, it is substantially coincident with the preform shape before the impregnation in case of SUS304 stainless steel as a substrate. On the other hand, in case of the preform using A5052 aluminum alloy as a substrate, a slight warp is caused at the side of the sprayed film because the substrate is dissolved in the bath in the immersion. However, such a warp deformation is rendered into substantially an negligible level by restricting the thickness of the substrate to not more than 1 mm.

Furthermore, when the preform is cut and the cut face is polished and observed by means of an electron microscope, it has been confirmed that the right amount of aluminum alloy is uniformly impregnated in a whole of the preform and an extremely thin diffusion layer is formed in a joint boundary between Ti and Al alloy and fully adhered to form a composite material.

EXAMPLE 3

In this example, a porous preform having a rectangular shape of 100 mm in length, 25 mm in width and 3 mm in thickness and having a hydrogenated nickel in its surface is prepared through the same plasma spraying method under a reduced pressure as in Example 1 by using 13% CR steel powder (grain size≦150 μm) covered with 20 mass % of Ni as a starting powder for spraying. When the porosity is determined by measuring the shape and weight of the preform, it is 56.2 vol %, and the labyrinth ratio is 3.9 and the hydrogen content is 0.8 mass %.

On the other hand, 350 g of A5052 aluminum alloy is melted in a crucible for a metal melt to form a matrix alloy bath, and the above preform is immersed thereinto at a bath temperature of 680° C. for 30 seconds and pulled out therefrom and solidified by cooling in air at room temperature.

As the shape of the thus obtained preform is measured, it is substantially coincident with the preform shape before the impregnation. And also, when the density of the preform (4996 kg/m$^3$) is determined by the measurement of the weight, it is confirmed to be substantially coincident with the density of the composite material determined assuming that aluminum alloy is filled in the pores of the preform (5001 kg/m$^3$). Furthermore, when the preform is cut and the cut face is polished and observed by means of an electron microscope, it has been confirmed that the right amount of aluminum alloy is uniformly impregnated in a whole of the preform and an extremely thin diffusion layer is formed in a joint boundary between Ti and Al alloy and fully adhered to form a composite material.

On the contrary, the preform is prepared under the same conditions as mentioned above except that hydrogen is not used as a plasma working gas for the comparison and the composite formation through the immersion in the aluminum alloy is examined, but the impregnation of the aluminum alloy into the preform is hardly observed.

EXAMPLE 4

In this example, a disc-shaped porous hydrogenated preform having an outer diameter of 25 mm and a thickness of about 3 mm is prepared by using a mixture of hydrogenated Ti powder (15 g) having an average grain size of 30 $\mu$m and Ti fiber (30 g) having an average fiber diameter of 30 $\mu$m and an average fiber length of 1.5 mm as a starting material and shaping it in a mold at a temperature of about 200° C. under a pressure of 120 kg/mm$^2$. When the porosity is determined by measuring the shape and weight of the preform, it is 35 vol % and also the labyrinth ratio is 4.1. Then, 350 g of A5052 aluminum alloy is melted in a crucible for a metal melt to form a matrix alloy bath. The above preform is immersed in the matrix alloy bath at 680° C. 30 seconds and pulled out therefrom and solidified by cooling in air at room temperature.

As the shape of the thus obtained preform is measured, it is substantially coincident with the preform shape before the immersion. And also, when the density (3880 kg/m$^3$) is determined by the measurement of the weight, it is confirmed to be substantially coincident with the density of the composite material assuming that aluminum alloy is filled in the pores. Furthermore, when the preform is cut and the cut face is polished and observed by means of an electron microscope, it has been confirmed that the right amount of aluminum alloy is uniformly impregnated in a whole of the preform and an extremely thin diffusion layer is formed in a joint boundary between Ti and Al alloy and fully adhered to form a composite material.

What is claimed is:

1. A metal-based composite material comprising:

a preform comprising a porous hydrogenatable metal selected from at least one of Ti, Fe, Co, Al, Cu, Mg, W, Mn, Cr, or Be, and having a hydrogen solubility at 500–600° C. of 0.1–10 cm$^3$/100 g of metal;

a metal hydride in at least part of the preform surface; and a matrix metal impregnating pores of the preform, the matrix metal comprising Al or an Al alloy containing at least one of Mg, Cu, or Si.

2. The metal-based composite material of claim 1, wherein the porous hydrogenatable metal comprises a porosity of 20–80% by volume.

3. The metal-based composite material of claim 1, wherein the porous hydrogenatable metal comprises a porosity of 30–70% by volume.

4. The metal-based composite material of claim 1, wherein the hydrogen solubility at 500–600° C. is 0.5–5 cm$^3$/100 g of metal.

5. The metal-based composite material of claim 1, wherein the porous hydrogenatable metal has a labyrinth ratio of about 2–5.

6. The metal-based composite material of claim 1, wherein the porous hydrogenatable metal has a labyrinth ratio of about 3–4.

7. The metal-based composite material of claim 1, wherein the porous hydrogenatable metal comprises an average pore size of 10–30 $\mu$m.

8. The metal-based composite material of claim 1, wherein the porous hydrogenatable metal comprises a hydrogen content of 0.2–2 mass percent.

9. A method of producing a metal-based composite material, which comprises using a hydrogenatable metal selected from Ti Fe, Co, Al, Cu, Mg, W, Mn, Cr, Be and an alloy thereof as a starting material, shaping it into a porous body having a porosity of 20–80 vol %, forming a metal hydride on at least a part of the porous body to produce a porous preform, immersing the preform in a matrix metal bath of Al or an Al alloy containing Mg, Cu and/or Si held in an air atmosphere under no pressure to impregnate the matrix metal into the preform.

10. The method according to claim 9, wherein the preform is formed by the shaping of the porous body and at the same time the production of the metal hydride on at least a part thereof.

11. The method according to claim 9, wherein the preform is formed by spraying powder of the hydrogenatable metal.

12. The method according to claim 9, wherein the preform is formed by covering a surface of the porous body with a layer of the hydrogenatable metal selected from Ti, Fe, Co, Al, Cu, Mg, W, Mn, Cr, Be and an alloy thereof and having a metal hydride in a part thereof.

13. The method according to any one of claim 9, wherein the matrix metal in the bath is impregnated into pores of the preform at a volume filling ratio of 90–150 mass %.

14. A method of producing a metal-based composite material, which comprises using a hydrogenatable metal selected from Ti Fe, Co, Al, Cu, Mg, W, Mn, Cr, Be and an alloy thereof as a starting material, shaping it into a porous body having a porosity of 20–80 vol %, forming a metal hydride on at least a part of the porous body to produce a porous preform, immersing the preform in a matrix metal bath of Al or an Al alloy containing Mg, Cu and/or Si held in an air atmosphere under no pressure to impregnate the matrix metal into the preform and then conducting a heat treatment after the impregnation of the matrix metal into the preform.

15. The method according to claim 14, wherein the preform is formed by the shaping of the porous body and at the same time the production of the metal hydride on at least a part thereof.

16. The method according to claim 14, wherein the preform is formed by spraying powder of the hydrogenatable metal.

17. The method according to claim 14, wherein the preform is formed by covering a surface of the porous body with a layer of the hydrogenatable metal selected from Ti Fe, Co, Al, Cu, Mg, W, Mn, Cr, Be and an alloy thereof and having a metal hydride in apart thereof.

18. The method according to claim 14, wherein the matrix metal in the bath is impregnated into pores of the preform at a volume filling ratio of 90–150 mass %.

* * * * *

UNITED STATES PATENT AND TRADEMARK OFFICE

CERTIFICATE OF CORRECTION

PATENT NO. : 6,548,183 B2 
DATED : April 15, 2003
INVENTOR(S) : Y. Kobayashi et al.

It is certified that error appears in the above-identified patent and that said Letters Patent is hereby corrected as shown below:

Column 8,
Line 32, delete "any one of".
Lines 37 and 56, "Ti" should be -- Ti, --.

Signed and Sealed this

Eighteenth Day of November, 2003

JAMES E. ROGAN
*Director of the United States Patent and Trademark Office*